United States Patent [19]

Merkle

[11] 4,022,995

[45] May 10, 1977

[54] INTERMEDIATE LEVERS FOR SAFETY CUT-OUT SWITCH WITH LOCK

[76] Inventor: Paul Merkle, Eschenbrunnlestr. 48, 7032 Sindelfingen, Germany

[22] Filed: June 11, 1975

[21] Appl. No.: 585,748

[30] Foreign Application Priority Data

June 12, 1974 Germany ..... 2428295

[52] U.S. Cl. ..... 200/44

[51] Int. Cl.[2] ..... H01H 9/28

[58] Field of Search ..... 200/44, 42 R, 42 T

[56] References Cited

UNITED STATES PATENTS

| | | | |
|---|---|---|---|
| 1,789,462 | 1/1931 | Douglas | 200/44 |
| 1,826,509 | 10/1931 | Douglas | 200/44 |

*Primary Examiner*—Herman Hohauser

[57] ABSTRACT

A sufficient distance is provided between the edge of a toggle switch disk and a lock by an intermediate lever supported at its rear to swivel its forward upper end upwards and downwards, through suitable actuating devices, into locking engagement and disengagement, respectively, with a notch in the toggle switch disk.

6 Claims, 6 Drawing Figures

INTERMEDIATE LEVERS FOR SAFETY CUT-OUT SWITCH WITH LOCK

The subject matter of the invention relates to three intermediate levers for saftey cut-out switch with lock for electrical lines which enable a sufficient distance between toggle disk edge and lock to be bridged. Due to this sufficiently large distance, finger and hand injuries during the operation of the switch are avoided.

Figure 2:
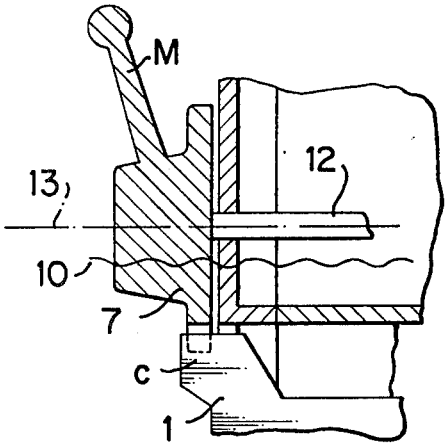
FIG. 2 is a sectional view along section lines 2-2 in FIG. 1.

Referring to the FIGURES, the switch for which the lock means according to the invention is used of a known type, comprising a rotatable axial shaft 12 (rotable about rotational axis 13) to which the actuating member 11 is secured. Dash-dotted line 13 is the same as the dash-dotted lines in FIGS. 3,4, and 5. FIG. 2 is the upper part associated with FIGS. 3,4, and 5 in which the upper parts of the safety switch are broken away along the line 10.

Figure 1:
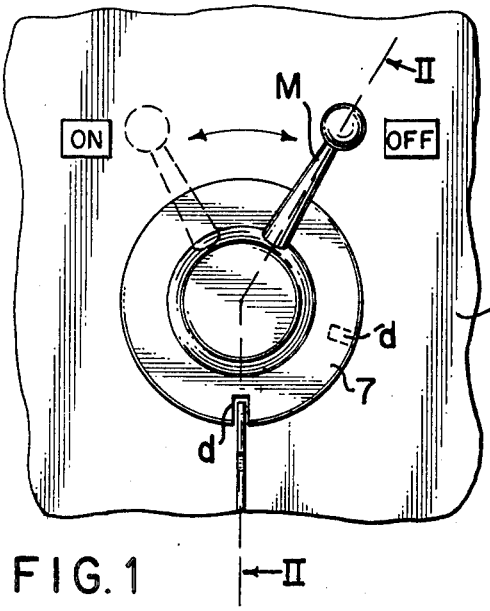
FIG. 1 is a front view of a toggle switch and disk of known design, together with a blocking member.
Figure 3:
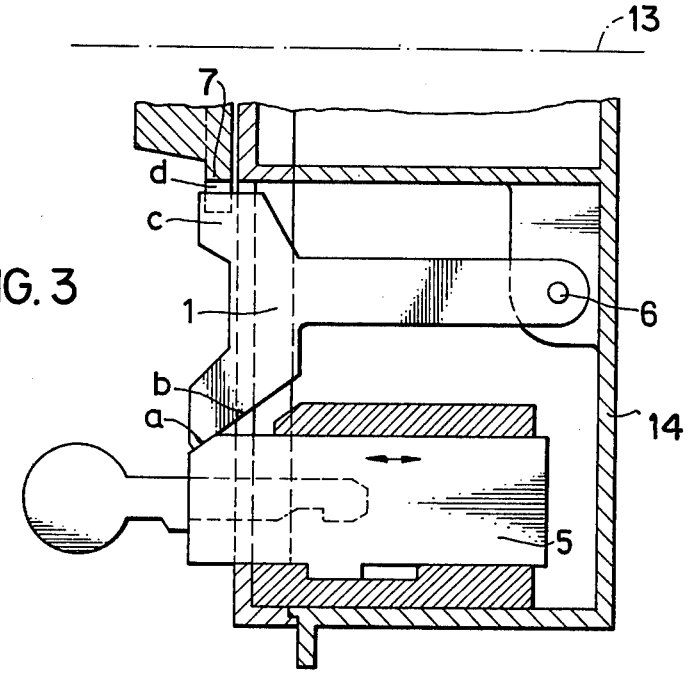
FIG. 3 shows one embodiment of an intermediate locking insert lever according to the invention.
Figure 4:
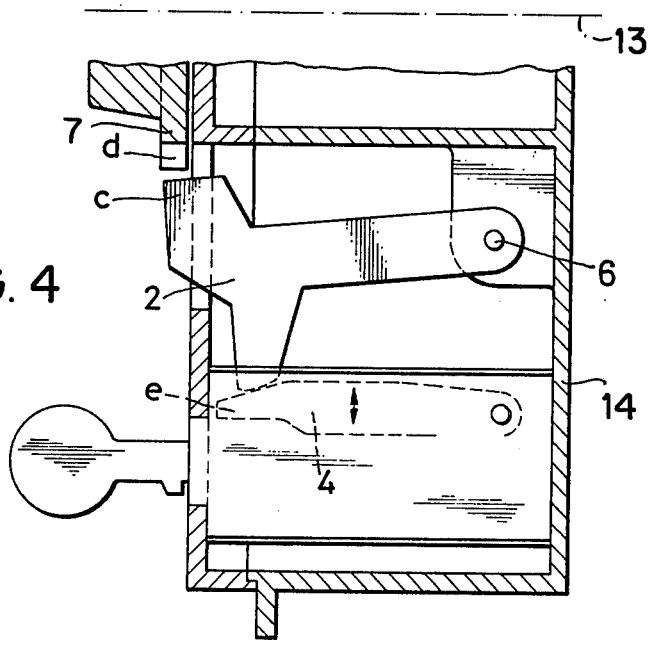
FIG. 4 shows a second embodiment of an intermediate locking insert lever according to the invention.

The arrangement of the switch contacts and their special embodiments are not of any importance with regard to the invention. It is only necessary, that in the off-position, for instance shown in FIG. 1, these contacts are open and that in one or more on-positions, one or more contacts of the switch are closed. When the switch is in its off-position, a blocking member, for instance the foreword upper and *c* of the intermediate lever 1 may engage with a cut-out notch *d* of the switch toggle disc 7, thus blocking the rotation of the latter and of the associated axial shaft 12. The lock means, comprising the intermediate lever 1 is arranged below the switch means in a lower part of a housing 14. In this housing the intermediate levers 1 to 4 of the embodiments shown in the FIGS. 3 to 6 are supported at their far ends to swivel about a bolt 6 or 10, this swivelling motion being controlled by the inward or outward motion of a lock insert 5 or 9, which is operated by means of a key 15. In its outer and inner end positions, the lock insert 5 or 9 may be locked to the housing 14 by means of the key 15. When the insert member 5 or 9 is in its outer position, the switch is locked by engagement of an upper end *c* or *i* of the intermediate levers 1, 2, 3, or 4 in the notch *d* of the switch toggle disc 7, thus blocking the rotation of the latter. The first two levers (1 and 2) of this group are represented in FIGS. 3 and 4 they are T-shaped. At intermediate lever 1 the motion is transmitted via an oblique pair of edges *a* and *b*, of which edge *a* is the canted forward corner of the lock insert 5. The intermediate lever 1, in the same manner as the intermediate lever 2, is supported at its rear end to swivel about the bolt 6 and, upon outward movement of the lock insert, moves with its forward upper end in the upward direction whereas its forward upper end *c* engages in a notch *d* of the switch toggle disk thus blocking the rotation of the latter. Accordingly, the switch toggle disk is unlocked by the inward movement of the lock insert 5, the forward upper end *c* of the intermediate lever 1 disengaging from the notch *d* of the switch toggle disk 7 and thus enabling the switch toggle disk to be rotated again.

Figure 5:
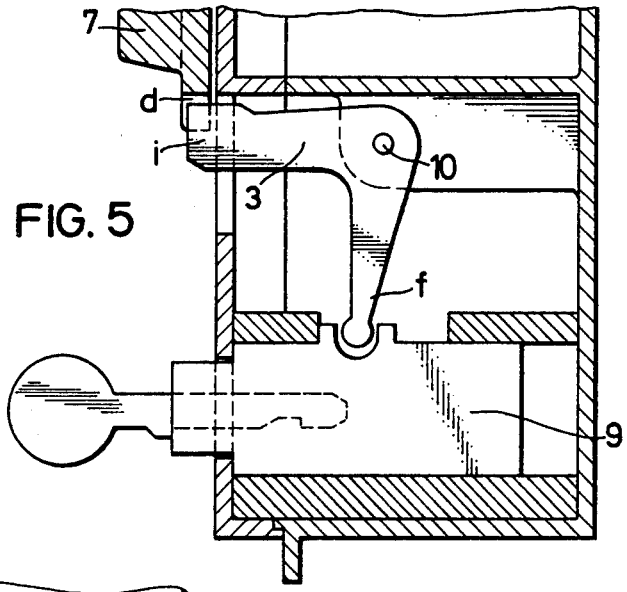
FIG. 5 shows a third embodiment of an intermediate locking insert lever according to the invention.
Figure 6:
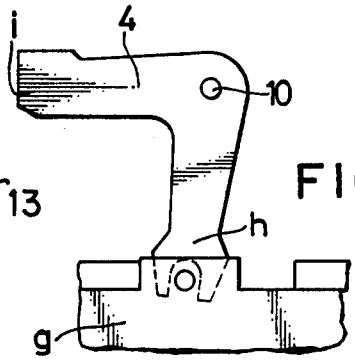
FIG. 6 shows a fourth embodiment of an intermediate locking insert lever according to the invention.

The intermediate lever 2, which serves exactly the same purpose as intermediate lever 1, and which is represented in FIG. 4, differs from intermediate lever 1 only in that it is not swivelled upward by an oblique displacement edge of a horizontally shiftable part but by the horizontally arranged leg *e* of a swivel lever 4. The two embodiments of the third intermediate lever are represented in FIGS. 5 and 6 as intermediate levers 3 and 4. The horizontally arranged leg *i* of the intermediate levers 3 or 4, which are supported to swivel about bolt 10, also engages in a notch *d* of the switch toggle disk 7 and thus blocks the rotation of the latter. In contrast to intermediate lever 3, the lower end *f* of which is designed as circular disk, the vertically arranged leg of intermediate lever 4 has a bifurcated end *h* and normally encloses a bolt of lock insert 9. During the inward movement of lock insert 9 the intermediate lever 3 or 4 performs an anti-clockwise swivel motion about bolt 10 and thus releases the switch toggle disk by means of its horizontal leg *i*. Locking of the switch is effected by the outward movement of lock insert 9 which causes the intermediate lever 3 or 4 to swivel in the clockwise direction and its end *i* to re-engage in notch *d* of the switch toggle disk.

What is claimed is:

1. A safety cut-out switch comprising a rotatable knob, a disk-shaped member integral with said rotatable knob and having at its lower periphery a notch, a lever engagable into said notch for locking said disk and to thereby lock said knob in the cut-out position of the switch, a lever blocking member for blocking said lever in its disk-locking position, and a key-actuated unlocking means for removing said lever from its disk-locking position, said disk-shaped member surrounding the base of said rotatable knob and having said notch extending in the switched-off position in a vertical downward direction, said lever having a forward upper end portion and a rear fulcrum and being arranged to be swivelled about said rear fulcrum and to engage and disengage said notch by upward and downward movement, respectively, of said forward upper end portion, said lever blocking member comprising a lock insert controlling by its outward and inward movement the upward and downward movement of said forward upper end portion of said lever, said lock insert being moveable outward only when said notch is extending in the switched-off position.

2. A safety cut-out switch according to claim 1, in which said lock insert has a canted corner and said lever is T-shaped and has a lower oblique edge, the motion of said lock insert being transmitted to said forward upper end portion via said lower oblique edge abutting against said canted corner of said lock insert.

3. A safety cut-out switch according to claim 2, comprising a swivel lever intermediate said lock insert and said T-shaped lever, said lock insert movement being transmitted to said T-shaped lever by means of said intermediate swivel lever.

4. A safety cut-out switch according to claim 1, in which said lock insert is horizontally displaceable and said lever is a bellcrank lever with a horizontally arranged leg for engagement with said notch of said switch toggle disk and a vertically arranged leg adapted to engage with said horizontally displaceable lock insert.

5. A safety cut-out switch according to claim 4, in which said lock insert has a recess therein and the lower end of said vertically arranged leg is provided with a circular disk engaging with said recess of said lock insert.

6. A safety cut-out switch according to claim 4, in which said lock insert has a bolt thereon, said vertically arranged leg being provided with a bifurcated and enclosing said bolt of said lock insert.

* * * * *

UNITED STATES PATENT OFFICE
CERTIFICATE OF CORRECTION

Patent No. 4,022,995 Dated May 10, 1977

Inventor(s) Paul Merkle

It is certified that error appears in the above-identified patent and that said Letters Patent are hereby corrected as shown below:

On the cover sheet delete the figure as shown and substitute the following figure on the attached sheet.

UNITED STATES PATENT OFFICE
CERTIFICATE OF CORRECTION

Patent No. 4,022,995 Dated May 10, 1977

Inventor(s) Paul Merkle

It is certified that error appears in the above-identified patent and that said Letters Patent are hereby corrected as shown below:

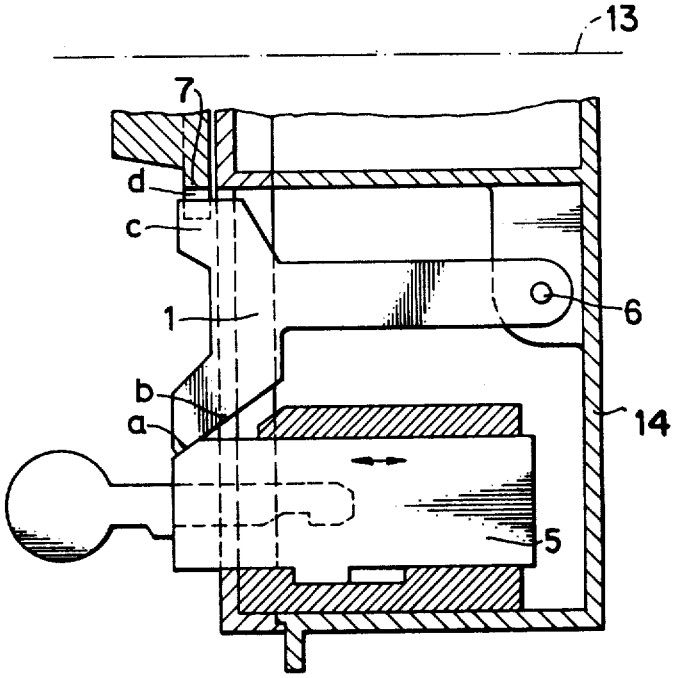

Signed and Sealed this

Twentieth Day of September 1977

[SEAL]

Attest:

RUTH C. MASON
Attesting Officer

LUTRELLE F. PARKER
Acting Commissioner of Patents and Trademarks